US007673821B2

(12) United States Patent
Norrman et al.

(10) Patent No.: US 7,673,821 B2
(45) Date of Patent: Mar. 9, 2010

(54) BEARING FOR A SHAFT OF A GYRATORY CRUSHER AND METHOD OF ADJUSTING THE GAP WIDTH OF THE CRUSHER

(75) Inventors: Percy Norrman, Landskrona (SE); Bengt-Arne Eriksson, Svedala (SE); Niklas Bennstedt, Svärdsjö (SE); Rolf Silfver, Beddingestrand (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 12/071,458

(22) Filed: Feb. 21, 2008

(65) Prior Publication Data

US 2008/0203203 A1 Aug. 28, 2008

(30) Foreign Application Priority Data

Feb. 22, 2007 (SE) ..... 0700425

(51) Int. Cl.
*B02C 1/00* (2006.01)
*B02C 23/18* (2006.01)
*B02C 15/10* (2006.01)
*B02C 17/08* (2006.01)

(52) U.S. Cl. ..... 241/15; 241/26; 241/30; 241/208; 241/216

(58) Field of Classification Search ..... 241/207, 241/216, 208, 214, 215, 15, 26, 30
See application file for complete search history.

(56) References Cited

U.S. PATENT DOCUMENTS

| | | | | |
|---|---|---|---|---|
| 3,384,312 A | | 5/1968 | Patterson et al. | |
| 3,782,647 A | | 1/1974 | Decker et al. | |
| 3,801,026 A | | 4/1974 | Decker et al. | |
| 4,016,630 A | * | 4/1977 | Bengtsson et al. | 241/207 |
| 4,037,800 A | * | 7/1977 | Coxhill | 241/213 |
| 4,060,205 A | * | 11/1977 | Pollak | 241/211 |
| 4,084,756 A | * | 4/1978 | Coxhill | 241/213 |
| 6,772,970 B2 | * | 8/2004 | Davis et al. | 241/210 |
| 2006/0144979 A1 | | 7/2006 | Nieminen et al. | |

FOREIGN PATENT DOCUMENTS

| | | |
|---|---|---|
| WO | 99/22869 | 5/1999 |
| WO | 2005/102530 A1 | 11/2005 |
| WO | 2006/067277 | 6/2006 |
| WO | 2007/041819 A1 | 4/2007 |

OTHER PUBLICATIONS

International Search Report mailed May 5, 2008 issued in PCT Application No. PCT/SE2008/000087.

* cited by examiner

*Primary Examiner*—Bena Miller
(74) *Attorney, Agent, or Firm*—Drinker Biddle & Reath LLP

(57) ABSTRACT

A gyratory crusher includes a crushing head on which a first crushing shell is mounted, and a frame on which a second crushing shell is mounted. The second crushing shell defines, together with the first crushing shell, a crushing gap. The gyratory crusher includes a space adapted to hold a liquid. The space is defined by a piston and a cylinder, any one of the piston and the cylinder being formed at least partly of a substantially vertical shaft around which the crushing head is arranged. The space is adapted to form, together with the liquid, a cushion, thereby enabling the cushion to serve as a thrust bearing and transmit vertical forces from the crushing head to the frame.

11 Claims, 4 Drawing Sheets

BEARING FOR A SHAFT OF A GYRATORY CRUSHER AND METHOD OF ADJUSTING THE GAP WIDTH OF THE CRUSHER

CROSS-REFERENCE TO PRIOR APPLICATION

The application claims priority to Swedish Application No. 0700425-2 filed Feb. 22, 2007, which is incorporated by reference herein.

FIELD OF THE INVENTION

The present invention relates to a gyratory crusher, which includes a crushing head on which a first crushing shell is mounted, and a frame on which a second crushing shell is mounted, the second crushing shell defining, together with the first crushing shell, a crushing gap, the width of which is adjustable by changing the vertical position of the first crushing shell relative to the vertical position of the second crushing shell by way of at least one adjusting device, a driving device being arranged to cause the crushing head to perform a gyratory pendulum movement with a view to crushing a material that is introduced into the crushing gap.

The present invention further relates to a method of adjusting a gap width in a gyratory crusher of the type stated above.

BACKGROUND OF THE INVENTION

A gyratory crusher of the type stated above can be used for crushing, for example, ore and stone material into smaller-size particles.

WO 99/22869 discloses a gyratory crusher, in which a crushing head is mounted on a gyrating vertical shaft. At its lower end, the vertical shaft is supported by a thrust bearing including three horizontal bearing plates. A first bearing plate is fastened to the vertical shaft, a second bearing plate is fastened to a piston arranged below the vertical shaft, and a third bearing plate is slideably and rotatably arranged between the first and the second bearing plate. The first and second bearing plates are generally made of a bearing metal, such as bronze, and the third bearing plate is often made of steel. The piston arranged below the vertical shaft forms, together with a cylinder, a hydraulic piston arrangement by way of which the vertical position of the vertical shaft can be displaced for the purpose of setting a desired crushing gap between the first and the second crushing shell.

WO 2006/067277 discloses a gyratory crusher in which a crushing head rotates about an immobile vertical shaft. Inside the crushing head, a piston and a cylinder are arranged, which together form a hydraulic piston arrangement. The crushing head may either include a cylinder or, according to an alternative embodiment, support a piston. The complementary piston or, according to the alternative embodiment, cylinder rests on a thrust bearing supported by the upper portion of the vertical shaft. The thrust bearing consists of a first horizontal bearing plate, which is fastened to the piston, alternatively to the cylinder, and a second horizontal beating plate, which is fastened to the upper portion of the vertical shaft.

A drawback of both of the crushers described above is that the existing types of thrust bearings are expensive and the horizontal bearing plates included therein are subjected to considerable wear, which necessitates frequent changes of the thrust bearings at a high cost.

SUMMARY

It is an object of the present invention to provide a gyratory crusher in which the above drawbacks have been considerably reduced, or completely eliminated.

According to a first aspect of the present invention, a gyratory crusher includes a crushing head, a first crushing shell mounted on the crushing head, a frame, and a second crushing shell mounted on the frame. The second crushing shell and the first crushing shell defining a crushing gap therebetween, the width of the gap being adjustable by changing a vertical position of the first crushing shell relative to a vertical position of the second crushing shell by way of at least one adjusting device. A driving device is arranged to cause the crushing head to perform a gyratory pendulum movement with a view to crushing a material that is introduced in the crushing gap. The gyratory crusher includes a space for holding a liquid, the space being defined by a piston and a cylinder, any one of the piston and the cylinder being formed at least partly of a substantially vertical shaft around which the crushing head is arranged. The space is adapted to form, with the aid of the liquid, a cushion, thereby enabling the cushion to act as a thrust bearing and transmit vertical forces from the crushing head to the frame.

An advantage of a gyratory crusher of this kind is that the space transmits, with the aid of the liquid, forces from the crushing head and also serves as a thrust bearing. By the thrust bearing being formed of a liquid cushion, no real mechanical wear will arise during the operation of the crusher. Also, the risk of damaging any bearing plates is eliminated. This substantially reduces the cost of maintaining the crusher. A further advantage is that the large power losses caused by bearing plates rubbing against one another thereby causing frictional heat can be avoided. Thus, a gyratory crusher is provided which consumes less energy than previously known crushers.

According to a preferred embodiment, the space is incorporated in the adjusting device, the space being adapted to hold a variable amount of liquid for setting a desired vertical position of the first crushing shell. An advantage of this embodiment is that the space will have double functions: on the one hand to serve as a hydraulic thrust bearing and, on the other hand, to serve as an adjusting device for adjusting the position of the crushing head in the vertical direction and, thus, of the first crushing shell, since a variable amount of liquid can be supplied to the space. This means that no separate adjusting device is needed for adjusting the vertical position of the first crushing shell relative to the vertical position of the second crushing shell.

According to a preferred embodiment, the vertical shaft is fixedly connected to the frame and the crushing head is rotatable about the vertical shaft, the space being formed at least partly inside the crushing head. An advantage of a crusher of this type is that it is highly compact, since the space is formed inside the crushing head. In the case where the space also serves as an adjusting device, a highly compact and simple construction is obtained. Such a compact construction is a great advantage, in particular in the case of crushers where small outer dimensions are important, for example mobile crushing mills that need to be moved in a simple manner. According to an even more preferred embodiment, the space is located at least partly above the upper end of the vertical shaft. An advantage of this embodiment is that it allows vertical forces to be transmitted directly from the crushing head to the vertical shaft by way of the cushion formed in the space. According to an even more preferred embodiment, the piston is formed at least partly of the vertical shaft, and the crushing head includes the cylinder. An advantage of this embodiment is that it requires very few parts. The vertical shaft is generally of relatively large dimensions and is therefore well adapted for use as a piston and for absorbing vertical forces from the crushing head and transferring these forces to the frame. Conveniently, the space is positioned at least partly on the same level as the first crushing shell, as seen in the vertical direction.

According to another preferred embodiment, the crushing head is fixedly connected to the vertical shaft, which is rotatable relative to the frame and displaceable in the vertical direction, the space being positioned at least partly substantially vertically below the vertical shaft. An advantage of this embodiment is that the shaft will have the double functions of supporting the crushing head and, the crushing head being fixedly connected to the shaft, of transmitting forces from the crushing head to the cushion formed in the space and then to the frame. According to an even more preferred embodiment, the piston is formed at least partly of the vertical shaft, the frame including the cylinder. The vertical shaft is generally of relatively large dimensions and therefore well adapted for use as a piston and for absorbing vertical forces from the crushing head. If the vertical shaft is used as a piston, a simple construction requiring few parts is obtained.

According to a preferred embodiment, the crusher is arranged to directly transmit vertical forces from the crushing head to the frame by way of the cushion formed by the space with the aid of the liquid, in the absence of intermediate horizontal bearing plates. An advantage of this embodiment is that expensive bearing plates can be avoided, which reduces both investment and maintenance costs.

Conveniently, the space is adapted to form, with the aid of the liquid, a cushion having a thickness of at least 1 cm. An advantage of this embodiment is that a thickness of about 1 cm offers a certain margin in the case of pressure shocks, so that the piston does not touch the bottom or top, respectively, of the cylinder, which could cause undesired wear and mechanical damage to, for example, the vertical shaft or the crushing head.

According to a further alternative embodiment, the vertical position of the second crushing shell relative to the frame is adjustable. As described above, it is usually preferred for the space to serve both as a hydraulic thrust bearing and as an adjusting device. However, it may be suitable, in some cases, to make use, as an alternative to or in combination with the adjusting device, of an adjusting feature also for positioning the second crushing shell relative to the frame.

A further object of the present invention is to provide a simple method of adjusting a gap width, i.e. a distance between a first crushing shell and a second crushing shell, the method resulting in lower maintenance costs than the methods known in the art.

According to a second aspect of the present invention, a method of adjusting a gap width in a gyratory crusher, includes providing a crushing head on which a first crushing shell is mounted, and a frame on which a second crushing shell is mounted, the second crushing shell defining, together with the first crushing shell, a crushing gap, the width of which is adjustable by changing the vertical position of the first crushing shell relative to the vertical position of the second crushing shell by way of an adjusting device, a driving device being arranged to cause the crushing head to perform a gyratory pendulum movement with a view to crushing a material that is introduced in the crushing gap. The liquid is supplied to a space incorporated in the adjusting device, the space being defined by a piston and a cylinder, any one of the piston and the cylinder being formed at least partly of a substantially vertical shaft around which the crushing head is arranged, the liquid being supplied in an amount such that the desired vertical position of the first crushing shell is set, a cushion being formed by the liquid supplied to the space and serving as a thrust bearing, whereby vertical forces are transmitted from the crushing head via the cushion to the frame.

An advantage of this method is that a smooth and easy adjustment of the gap width is obtained while, at the same time, a bearing is provided in the axial direction between the crushing head and the frame in a manner that is compatible with low maintenance costs.

According to an even more preferred embodiment, forces are transmitted directly from the crushing head to the cushion and then to the frame without being passed through any horizontal bearing plates. By eliminating horizontal bearing plates, the investment costs, power consumption and maintenance costs are reduced and a crusher of smaller height can be designed, since the bearing plates would have added to its height.

Further advantages and features of the invention will be apparent from the following description and the appended claims.

BRIEF DESCRIPTION OF THE DRAWINGS

In the following, the invention will be described by way of embodiments and with reference to the appended drawings.

DETAILED DESCRIPTION OF THE PREFERRED EMBODIMENTS

Figure 1A:
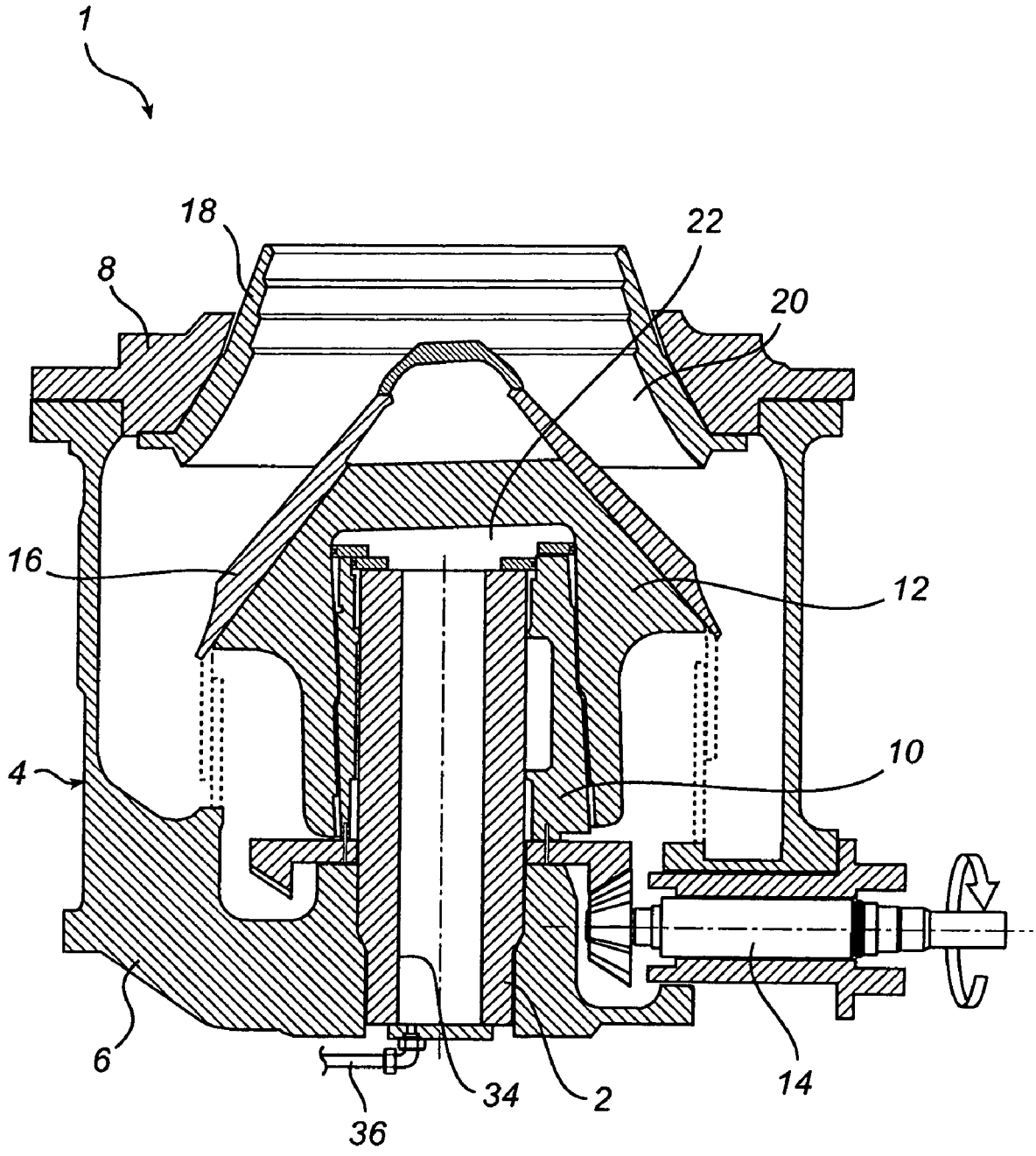
FIG. 1*a* is a schematic view of a gyratory crusher according to a first embodiment, in which gyratory crusher a first and a second crushing shell are located in a first position relative to one another.

FIG. 1*a* illustrates schematically a gyratory crusher 1, which has a vertical shaft 2 and a frame 4 including a frame bottom part 6 and a frame top part 8. The vertical shaft 2 is fixedly attached to the frame bottom part 6 of the frame 4. An eccentric 10 is rotatably arranged about the vertical shaft 2. A crushing head 12 is rotatably arranged about the eccentric 10, and thus about the vertical shaft 2. A drive shaft 14 is arranged to rotate the eccentric 10 by way of a motor (not shown). The outer periphery of the eccentric 10 is slightly inclined relative to the vertical plane, as illustrated in FIG. 1*a* and which is, as such, previously known. The inclination of outer periphery of the eccentric 10 means that the crushing head will also be slightly inclined relative to the vertical plane. As the drive shaft 14 rotates the eccentric 10, during operation of the crusher 1, the crushing head 12 will be made to rotate, executing in this connection a gyrating movement.

A first crushing shell 16 is fixedly mounted on the crushing head 12. A second crushing shell 18 is fixedly mounted on the frame top part 8. Between the two crushing shells 16, 18, a crushing gap 20 is formed, the width of which, in an axial section, decreases in the downward direction, as is illustrated in FIG. 1*a*. A material to be crushed can be introduced in the crushing gap 20 and be crushed between the first crushing shell 16 and the second crushing shell 18 due to the gyrating movement of the crushing head 12, a movement during which the two crushing shells 16, 18 approach one another along a rotating generatrix and move away from one another along a diametrically opposed generatrix.

Figure 1B:
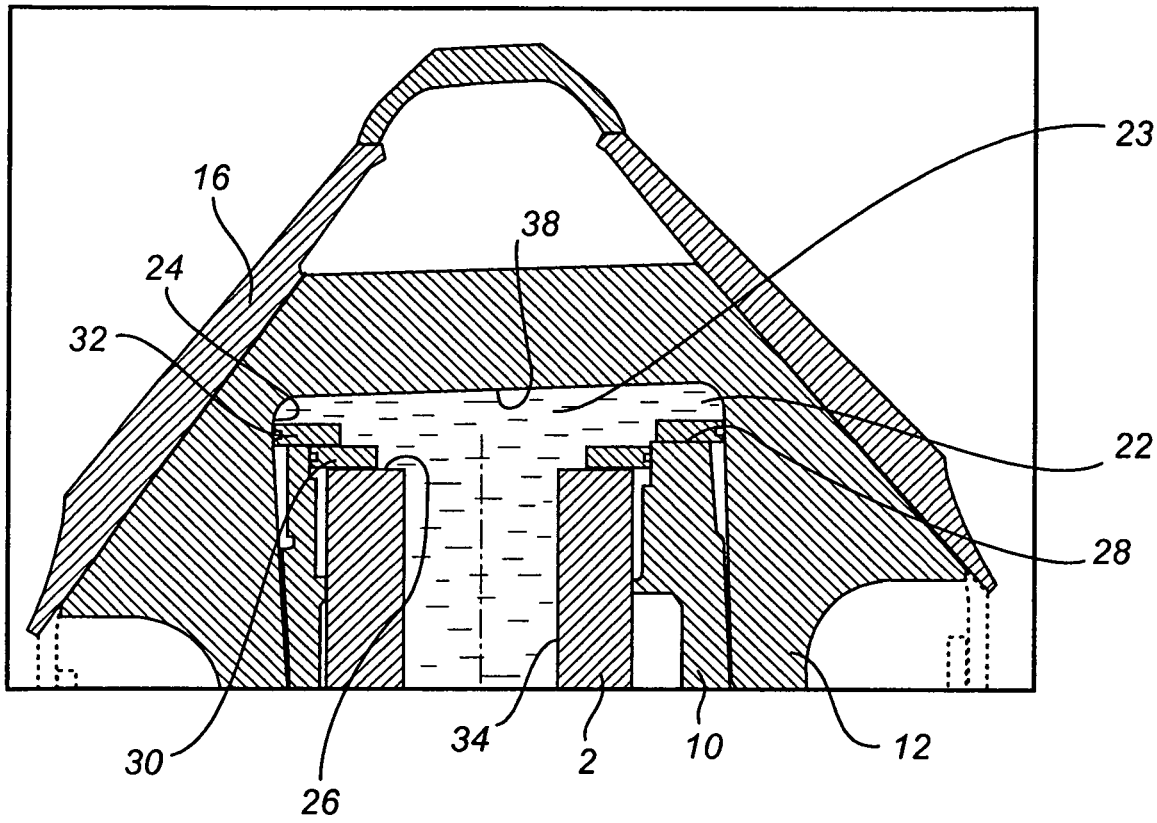
FIG. 1*b* is an enlarged view of a space shown in FIG. 1*a*.

The gyratory crusher 1 includes a space 22 adapted to hold a liquid, such as hydraulic liquid or lubricating oil. The space 22 is defined, as is best seen in FIG. 1*b*, by a cylinder 24, which is formed inside the crushing head 12, and a piston, which is formed partly of the upper end 26 of the vertical shaft 2 and partly of the upper end 28 of the eccentric 10. The piston, i.e. the upper end 26 of the shaft 2 and the upper end 28 of the eccentric, form together with the cylinder 24 a hydraulic piston arrangement. Because the eccentric 10 and the crushing head 12 are arranged to rotate relative to one another and relative to the shaft 2, a first sealing ring 30 is arranged on the upper end 26 of the shaft 2 for sealing against the eccentric 10, and a second sealing ring 32 is arranged on the upper end 28 of the eccentric 10 for sealing against the cylinder 24. Thus, the sealing rings 30, 32 are intended to prevent liquid from leaking out of the space 22 via bearings, not shown in detail, between on the one hand the shaft 2 and the eccentric 10 and, on the other hand, the eccentric 10 and the cylinder 24 formed inside the crushing head 12.

FIG. 1*a* illustrates an inner duct 34 arranged in the vertical shaft 2, through which a liquid can be supplied to the space 22. A supply tube 36 is arranged to supply a pressurized liquid from a liquid tank (not shown).

The space 22 is adapted to hold a certain amount of liquid and, with the aid of the liquid, to form a cushion 23 of liquid, which cushion 23 is illustrated in FIG. 1*b*. The cushion 23 serves as a hydraulic thrust bearing and transmits vertically oriented forces that are generated during crushing, from the crushing head 12 to the vertical shaft 2 and then to the frame 4. Accordingly, the cushion 23 formed by the space 22 with the aid of the liquid transmits the vertical forces generated and serves, at the same time, as a thrust bearing for the gyrating rotary movement executed, during operation, by the crushing head 12 relative to the eccentric 10 and to the shaft 2. The horizontal bearing plates used in prior art according to, for example, WO 2006/067277 can thereby be avoided.

Figure 2:
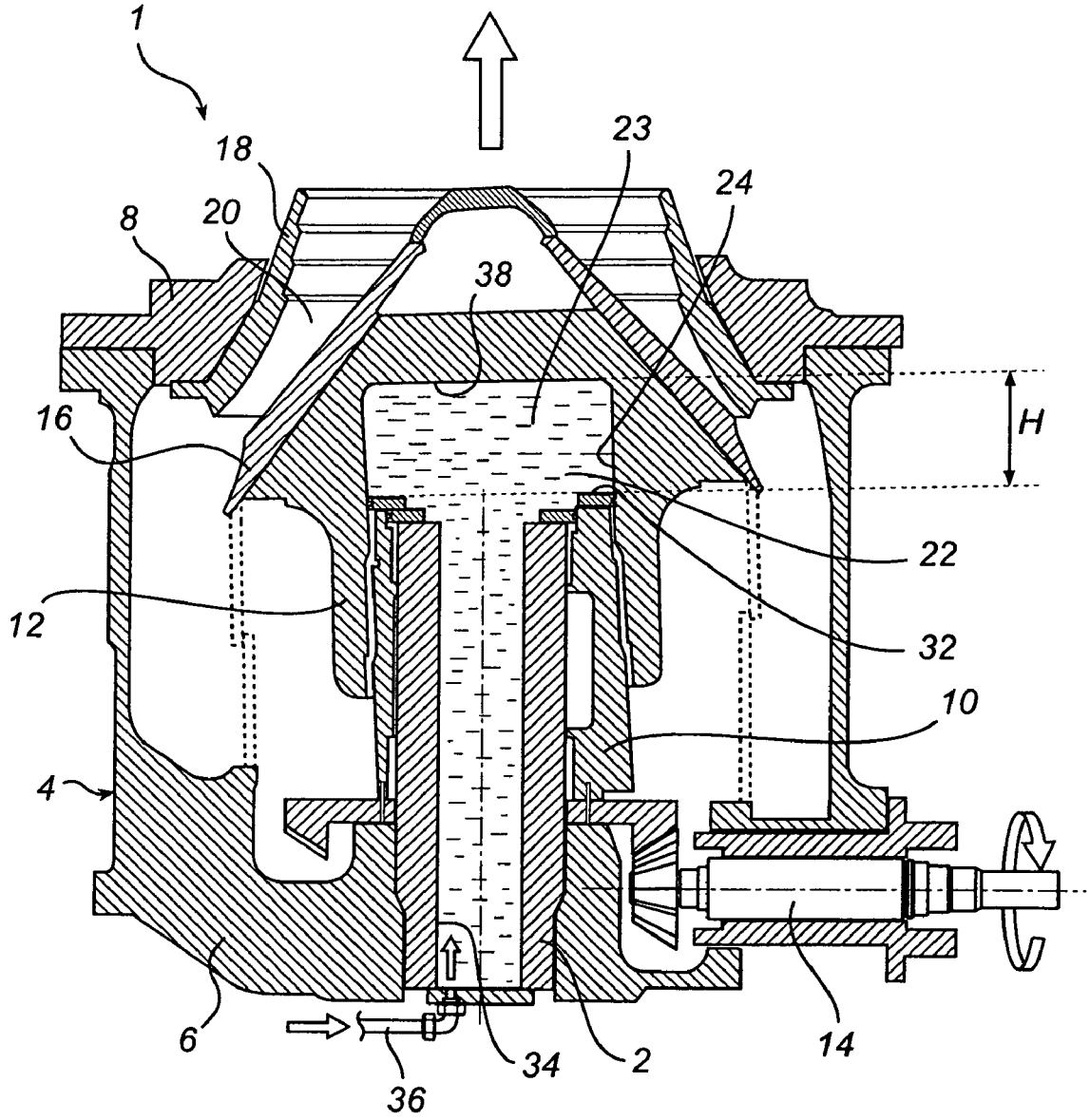
FIG. 2 is a schematic view of the gyratory crusher of FIG. 1*a*, but in which the first and the second crushing shell are in a second position relative to one another.

FIG. 2 shows the gyratory crusher 1 in a second adjusting position. The properties of the material crushed in the gyratory crusher 1 depend largely on the width of the crushing gap 20. Varying the width of the crushing gap 20, which is achieved, in the gyratory crusher 1, by moving the crushing head 12 in the vertical direction, can influence the properties of the crushed material. Such a vertical displacement is also used to compensate for any wear to the crushing shells 16, 18. In the gyratory crusher 1, a suitable width of the crushing gap 20 is set by supplying a variable amount of liquid to the space 22. As shown in FIG. 2, the liquid fills the inner duct 34 and the space 22 and thereby forms the cushion 23 in the space 22. In the position shown in FIG. 2, more liquid has been supplied to the space 22 compared with the position shown in FIG. 1*b*, which has caused the crushing head 12 to move upwards in the vertical direction relative to the frame 4, as shown in FIG. 2. As a result, the width of the crushing gap 20 has been reduced or, alternatively, wear to the crushing shells 16, 18 has been compensated for. In this manner, the cushion 23 formed by the space 22 with the aid of the liquid is used not only as a thrust bearing, but also as a component of the adjusting device, together with the tube 34 and the pipe 36, for adjusting the vertical position of the first crushing shell 16 relative to the vertical position of the second crushing shell 18. Accordingly, depending on the amount of liquid present in the space 22, a varying vertical distance H between the second sealing ring 32 and the upper end 38 of the cylinder 24 will be obtained. The vertical distance H can be said to correspond to the current thickness of the cushion 23 formed by the space 22 with the aid of the liquid. To ensure a satisfactory thrust bearing function, the thickness of the cushion 23, i.e. the distance H, should be at least 1 cm when the crushing head 12 is in its lowermost position.

As appears from both FIG. 1*a* and FIG. 2, the space 22 will be positioned at least partly on the same level as the first crushing shell 16, as seen in the vertical direction. This allows an even more compact design, since the space 22 is located in an area that is already incorporated in the crushing head 12.

Figure 3:
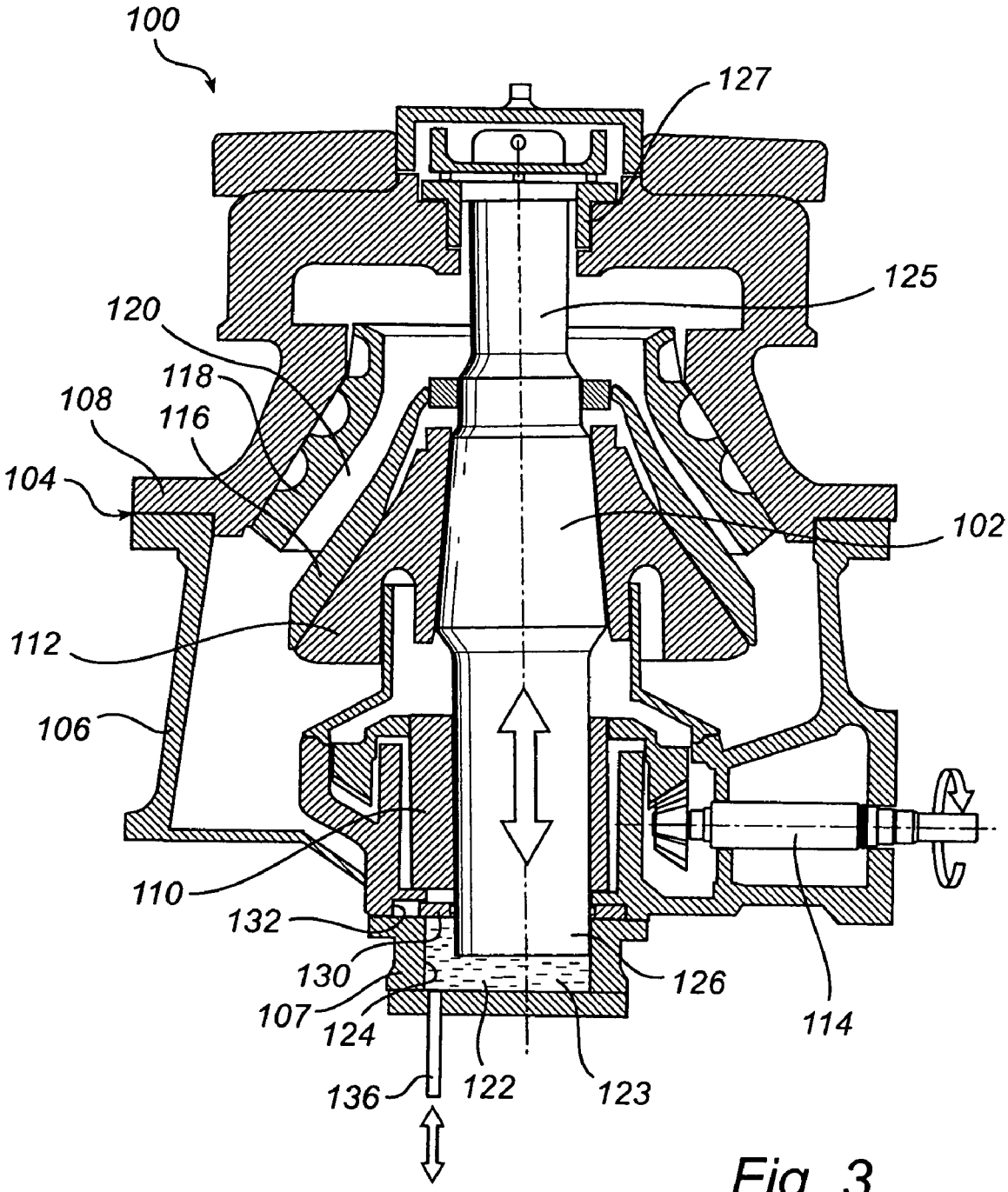
FIG. 3 is a schematic view of a gyratory crusher according to a second embodiment.

FIG. 3 illustrates schematically a gyratory crusher 100 according to an alternative embodiment. The gyratory crusher 100 has a vertical shaft 102 and a frame 104 including a frame bottom part 106 and a frame top part 108. An eccentric 110 is rotatably arranged about the vertical shaft 102. A crushing head 112 is fixedly mounted about the vertical shaft 102. A drive shaft 114 is arranged to rotate the eccentric 110 by way of a motor (not shown). The vertical shaft 102 is journalled, at its upper end, in a top bearing 127 provided in the frame top part 108. When the drive shaft 114 rotates the eccentric 110, during operation of the crusher 100, the shaft 102 and the crushing head 112 mounted thereon are made to rotate, executing in this connection a gyrating movement.

A first crushing shell 116 is fixedly mounted on the crushing head 112. A second crushing shell 118 is fixedly mounted on the frame top part 108. Between the two crushing shells 116, 118, a crushing gap 120 is formed, the width of which, in an axial section, decreases in the downward direction, as is illustrated in FIG. 3. A material to be crushed is introduced in the crushing gap 120 and crushed between the first crushing shell 116 and the second crushing shell 118 according to the principles described above with reference to FIG. 1*a*.

The gyratory crusher 100 includes a space 122 adapted to hold a liquid, such as hydraulic liquid or lubricating oil. The space 122 is defined by a cylinder 124, which is formed inside the lower portion 107 of the frame bottom part 106, and a piston, which is formed substantially of the lower end 126 of the vertical shaft 102. The piston, i.e. the lower end 126 of the shaft 102, forms together with the cylinder 124 a hydraulic piston arrangement. Because the vertical shaft 102 will execute a gyrating movement relative to the cylinder 124 and, in addition, will rotate about its own symmetry axis, a sealing ring 130 has been provided. As shown in FIG. 3, the sealing ring 130 can slide in a groove 132 to absorb the gyrating movement of the shaft 102. Thus, the purpose of the sealing ring 130 is to prevent liquid from leaking out of the space 122 via bearings, not shown in detail, between on the one hand the shaft 102 and the eccentric 110 and, on the other hand, the eccentric 110 and the frame bottom part 106.

The lower portion 107 of the frame bottom part 106 is provided with a tube 136 through which a liquid can be supplied to the space 122 from a pressurized liquid tank (not shown). The space 122 is adapted to hold a certain amount of liquid and, with the aid of the liquid, to form a cushion 123 of liquid. The cushion 123 serves as a hydraulic thrust bearing and transmits vertically oriented forces that are generated during crushing, from the crushing head 112 via the shaft 102 to the frame 104. Accordingly, the cushion 123 formed by the space 122 with the aid of the liquid transmits the vertical forces produced and, at the same time, serves as a thrust bearing for the gyrating rotary movement executed, during operation, by the crushing head 112 and the shaft 102 relative to the eccentric 110 and to the frame 104. Thus, the horizontal bearing plates used in prior art according to, for example, WO 99/22869 can be avoided.

The adjustment of the vertical position of the crushing head 112, and thereby of the first crushing shell 116, can be carried out according to essentially the same principles as described above with reference to FIG. 2. Accordingly, a liquid is supplied through the tube 136 in an amount such that the space 122 and the shaft 102, and thereby the crushing head 112 and the crushing shell 116 mounted thereon, reach a desired position in the vertical direction, as indicated by two-way arrows in FIG. 3.

It will be appreciated that a number of modifications to the embodiments described above are conceivable within the scope of the invention, as defined by the appended claims.

In the above description, the liquid supplied to the space 22 is hydraulic oil or lubricating oil. It will be appreciated that other types of liquids suitable for hydraulic piston arrangements can be used. For example, different types of hydraulic liquids, different types of oils, etc. can be supplied to the space 22.

According to the above description, the space 22, 122 has two functions: on the one hand to serve as a hydraulic thrust bearing and, on the other hand, to form part of the adjusting device for adjusting the vertical position of the crushing head 12, 112. It is also possible to use the space 22, 122 only as a hydraulic thrust bearing. In this case, any other device can be used to vary the vertical position of a first crushing shell relative to the vertical position of a second crushing shell. For example, the position of the second crushing shell relative to the frame top part can be adjusted. For this purpose, devices known in the art can be used, in which the vertical position of the second crushing shell is adjusted by way of a sleeve with a trapezoidal thread which is turned relative to the frame top part, see for example FIG. 1 of U.S. Pat. No. 4,478,373, or by way of a hydraulically adjustable frame top part, see for example FIG. 1 of U.S. Pat. No. 3,604,640. Typically, however, the most preferred embodiment is to combine the hydraulic thrust bearing function of the cushion 23; 123 with the vertical adjustment function as described above with reference to FIG. 1*a*, FIG. 1*b* and FIG. 2.

The disclosures in Swedish patent application No. 0700425-2, from which this application claims priority, are incorporated herein by reference.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A gyratory crusher, comprising:

a crushing head;

a first crushing shell mounted on the crushing head;

a frame;

a second crushing shell mounted on the frame;

the second crushing shell and the first crushing shell defining a crushing gap therebetween, the width of the gap being adjustable by changing a vertical position of the first crushing shell relative to a vertical position of the second crushing shell by way of at least one adjusting device;

a driving device arranged to cause the crushing head to perform a gyratory pendulum movement with a view to crushing a material that is introduced in the crushing gap;

wherein the gyratory crusher includes a space for holding a liquid, the space being defined by a piston and a cylinder, said piston being formed at least partly of or substantially of a vertical shaft around which the crushing head is arranged, the space being adapted to form, with the aid of said liquid, a cushion, thereby enabling said cushion to act as a thrust bearing and transmit vertical forces from the crushing head to the frame, wherein vertical forces are transmitted directly from the crushing head to the cushion and then to the frame without being passed through any horizontal bearing plates.

2. The gyratory crusher according to claim 1, wherein the space is incorporated in an adjusting device, the space being adapted to receive a variable amount of liquid for setting the desired vertical position of the first crushing shell.

3. The gyratory crusher according to claim 1, wherein the vertical shaft is fixedly connected to the frame and the crushing head is rotatable about said vertical shaft, said space being formed at least partly inside the crushing head.

4. The gyratory crusher according to claim 3, wherein the space is located at least partly above the upper end of the vertical shaft.

5. The gyratory crusher according to claim 3, wherein the piston is formed at least partly of said vertical shaft, and the crushing head includes said cylinder.

6. The gyratory crusher according to claim 5, wherein the space is located at least partly on the same level as the first crushing shell, as seen in the vertical direction.

7. The gyratory crusher according to claim 1, wherein the crushing head is fixedly connected to said vertical shaft, which is rotatable relative to the frame and movable in the vertical direction, the space being positioned at least partly substantially vertically below the vertical shaft.

8. The gyratory crusher according to claim 7, wherein the piston is formed at least partly of said vertical shaft, the frame including said cylinder.

9. The gyratory crusher according to claim 1, which is arranged to directly transmit vertical forces from the crushing head to the frame by way of the cushion formed by the space with the aid of the liquid, in the absence of intermediate horizontal bearing plates.

10. A gyratory crusher according to claim 1, wherein the space is arranged to form, with the aid of the liquid, a cushion with a thickness of at least 1 cm.

11. A method of adjusting a gap width in a gyratory crusher, comprising:

providing a crushing head onto which a first crushing shell is mounted, and a frame onto which a second crushing shell is mounted, the second crushing shell defining, together with the first crushing shell, a crushing gap, the width of which is adjustable by changing the vertical position of the first crushing shell relative to the vertical position of the second crushing shell by way of an adjusting device, a driving device being arranged to cause the crushing head to perform a gyratory pendulum movement with a view to crushing a material that is introduced in the crushing gap;

supplying liquid to a space incorporated in said adjusting device, which space is defined by a piston and a cylinder, said piston being formed at least partly of or substantially of a vertical shaft around which the crushing head is arranged, the liquid being supplied in an amount such that the desired vertical position of the first crushing shell is set, a cushion being formed by the liquid supplied to said space and acting as a thrust bearing, whereby vertical forces are transmitted from the crushing head via the cushion to the frame, wherein vertical forces are transmitted directly from the crushing head to the cushion and then to the frame without being passed through any horizontal bearing plates.

* * * * *